US008490964B2

(12) United States Patent
Kaiping

(10) Patent No.: US 8,490,964 B2
(45) Date of Patent: Jul. 23, 2013

(54) DOCUMENT FEEDER WITH PIVOTING DELIVERY TABLE, PARTICULARLY FOR DIGITAL PRINTERS

(76) Inventor: James C. Kaiping, Columbia, IL (US)

( * ) Notice: Subject to any disclaimer, the term of this patent is extended or adjusted under 35 U.S.C. 154(b) by 0 days.

(21) Appl. No.: 13/148,014

(22) PCT Filed: Sep. 10, 2010

(86) PCT No.: PCT/US2010/048425

§ 371 (c)(1),
(2), (4) Date: Aug. 4, 2011

(87) PCT Pub. No.: WO2011/031966

PCT Pub. Date: Mar. 17, 2011

(65) Prior Publication Data

US 2011/0291348 A1 Dec. 1, 2011

Related U.S. Application Data

(60) Provisional application No. 61/241,209, filed on Sep. 10, 2009, provisional application No. 61/372,745, filed on Aug. 11, 2010.

(51) Int. Cl.
*B65H 3/44* (2006.01)
*B65H 5/26* (2006.01)

(52) U.S. Cl.
CPC ..... *B65H 3/44* (2013.01); *B65H 2407/21* (2013.01)
USPC ..... 271/9.09; 271/9.12

(58) Field of Classification Search
USPC ..... 271/9.01, 9.09, 23, 35, 131, 133, 271/9.12; 221/177
See application file for complete search history.

(56) References Cited

U.S. PATENT DOCUMENTS

| | | | | |
|---|---|---|---|---|
| 6,932,338 | B1 * | 8/2005 | Popejoy et al. | 271/122 |
| 2003/0197324 | A1 * | 10/2003 | Cook | 271/35 |
| 2006/0220299 | A1 * | 10/2006 | Kaiping | 271/35 |

FOREIGN PATENT DOCUMENTS

| | | | | |
|---|---|---|---|---|
| GB | 2417949 | A | | 3/2006 |
| JP | 09026730 | A | * | 1/1997 |
| JP | 9026730 | A | | 1/1997 |
| JP | 10-045268 | A | | 1/1998 |
| JP | 2005059982 | A | * | 3/2005 |
| JP | 200682912 | A | | 3/2006 |
| JP | 2006082912 | A | * | 3/2006 |

OTHER PUBLICATIONS

Straight Shooter; D-12 Demand Feeder; Brochure, 2 pages; Straight Shooter Equipment Company, Columbia, IL 62236.
International Search Report from corresponding International Application No. PCT/US2010/048425, mailed Apr. 26, 2011.
Written Opinion from corresponding International Application No. PCT/US2010/048425, mailed Apr. 26, 2011.

* cited by examiner

*Primary Examiner* — Patrick Cicchino
(74) *Attorney, Agent, or Firm* — Polster, Lieder, Woodruff & Lucchesi, L.C.

(57) ABSTRACT

A sheet feeder assembly (1) includes a bottom-feed sheet feeder (3) and a delivery table (5) positioned to receive sheets from the sheet feeder and deliver the sheets one at a time to a top-feed mechanism (205) designed to feed the top sheet of a stack of sheets in a manual feed tray of a printer (7) or the like. The top-feed mechanism includes a lifting support (204) for a stack of sheets. An exit end of the delivery table rests on and moves with the lifting support and delivers sheets one at a time to the top-feed mechanism. A balance mechanism (75) reduces the effective weight of the delivery table.

17 Claims, 7 Drawing Sheets

DOCUMENT FEEDER WITH PIVOTING DELIVERY TABLE, PARTICULARLY FOR DIGITAL PRINTERS

CROSS REFERENCE TO RELATED APPLICATIONS

This application is a national stage application under 35 U.S.C. §371 of International application No. PCT/US2010/048425, filed Sep. 10, 2010. which. claims priority to U.S. provisional application 61/241,209, filed Sep. 10, 2009, and U.S. provisional application 61/372,745, filed Aug. 11, 2010, both all of which are hereby incorporated herein by reference.

TECHNICAL FIELD

This invention relates generally to sheet feeders for use with devices having an externally accessible feed mechanism that pulls a sheet from a stack of sheets. It has particular but not exclusive usefulness in feeding sheets to a bypass tray of a high speed digital printer (such as a laser printer, an LED printer, or an ink jet printer) which prints an image based on a digital file downloaded to the printer.

BACKGROUND ART

There are thousands of digital printers sold each year by many different manufacturers. Digital printing technology has been widely used for several decades. Typically, digital printers are used to print on standard thickness paper, commonly known as "copy paper" of common sizes such as 8.5"×11" or A4. Since the majority of usage on these printers consists of this type of paper, the feed systems on these printers are designed to handle this specific material well. A stack of paper is placed in a hopper that is incorporated into the body of the printer. The printer takes one sheet of paper at a time by pulling the top sheet off a stack of paper in the hopper with a feed roller or "feed tire" that is resting on the top of the stack.

Although this method works very well on standard paper, it is not capable of feeding difficult or thick sheets, such as envelopes, postcards, folded pieces, and other thick materials. The term "sheet" is used herein to encompass not only single sheets of paper, but also such things as envelopes, postcards, CDs, credit cards, labels, calendars, or any other object, generally on the order of a few thousandths of an inch to about ⅜ of an inch thick, and sufficiently flexible to flex on the order of 1/16 to ⅛ inch, that can be fed from a stack and that can be printed by the printer into which it is fed.

To accommodate occasional feeding of these thick or difficult sheets, many digital printers include a "manual feed tray" or "multi-purpose feed tray" or "bypass tray" that is open to the exterior of the digital printer when in use and is most often hinged to one side of the printer. In this tray (hereinafter called a "manual feed tray"), the user can normally place a few envelopes, cards or other thick sheets for printing when not printing on standard paper. Although these manual feed trays work reasonably well, they have very small limits on the size of the stack of sheets, and therefore cannot be used for large volumes of printing without constant reloading of media. In addition, these manual feed trays also incorporate a top feed design, meaning that they have a feed roller that pulls the top document off the stack in the manual feed tray. This means that the operator cannot load documents into the feed tray until the prior stack is depleted.

Attempts have been made to solve this problem by providing a separate sheet feeder that feeds envelopes to the feed roller of the manual feed tray. However, they require that changes be made to the printer's manual feed tray to accommodate the feeder. The manual feed trays of most existing digital printers are attached to one end of the digital printer, and typically are hinged to the printer. The manual feed tray typically rests at a slight angle, rising upwards as it extends away from the hinged point. The manual feed tray also incorporates media guides and other components that are positioned near the feed roller area. For these reasons, the manual feed tray blocks access to the feed roller and feed area on the printer. The manual feed tray therefore must be removed from the printer when using prior art add-on feeders. This eliminates the ability to use the manual feed tray without the use of the add-on feeder or for its normal purposes completely, unless the manual feed tray is re-attached to the printer.

SUMMARY OF THE INVENTION

The present invention provides a friction feeder assembly that is designed to be positioned near a printer's manual feed tray, and feed sheets, one at a time, to the manual feed tray feed roller, increasing dramatically the production capability of the printer when printing envelopes or other difficult sheets. Most commonly, the printer will be a digital printer, and the sheets will be envelopes or cards, but the invention is not limited thereto. Preferably and advantageously, no modification of the printer's manual feed tray or of the printer's sensors and electronics is required. The feeder assembly of the present invention may also be used with devices other than printers which incorporate a top-feed mechanism that draws sheets from the top of a stack.

The feeder is of top-load, bottom-feed design, meaning that a stack of sheets is placed in the feeder's hopper, and the bottom sheet is pulled away from the stack and delivered to the printer. With this construction, the operator can load more sheets in the feed hopper and continue to load on top of the stack, while the system is running. The feeder is conventionally driven by an electric motor. It is desirable but not essential in the present invention that the motor be a variable speed motor.

The feeder assembly of the present invention obviates the need to remove the manual feed tray from the printer by incorporating a delivery table that is attached to the feeder, and extends laterally away from the feeder in the direction of the printer. One end of this table is pivotally attached to the feeder, leaving the end closest to the printer vertically movable, so that it can be raised up while the feeder is moved into position adjacent the printer to clear the upwardly tilting manual feed tray described above and then tilted back down onto the manual feed tray to allow the end of the table to be positioned under the feed roller of the printer. When the feeder is placed in the proper position, the exit end of the delivery table is positioned just below the feed roller of the digital printer. When the printer is started, the manual feed tray is raised slightly by internal components of the printer. When this tray which is underneath the delivery table of the feeder rises, it lifts the pivoting delivery table up until it, or a sheet at its free end, activates the printer's top-of-stack sensor. By allowing the printer to lift the delivery table to the proper height, the delivery table is positioned exactly as needed to deliver the documents to the printer without interference.

It will of course be understood that the delivery table can be any structure which receives sheets from a sheet feeder and delivers them one at a time to a top-feed mechanism, and that the "table" need not incorporate a flat horizontal plate.

Since varying digital printers incorporate various manual feed tray designs and specifications, including height, the pivoting delivery table of the feeder of the present invention offers the ability to use it with a wide variety of printers. As described earlier, the manual feed tray of the digital printer typically rises a bit to push documents up to the feed roller. Since the rising force of these manual feed trays will vary, the pivoting delivery table may include an adjustable counterbalance or spring-loaded mechanism that reduces the effective weight of the delivery table and aids the feed tray in lifting the end of the delivery table to the proper height of the feed roller. The balance mechanism used in the preferred embodiment of the present invention is an adjustable spring, but it can also be an adjustable weight or shock absorbing device, for example. Preferably, the adjustable balance mechanism is capable of reducing the effective weight of the delivery table on the feed tray by at least 10%, desirably by at least 25%, and preferably by at least 50%.

The delivery table of the preferred embodiment includes a drive roller at its rearward, or upstream, end. The drive roller is conveniently driven by a timing belt trained around a pulley on a drive roller of the feeder. This arrangement ensures that movement of sheets across the delivery table is synchronized with ejection of sheets from the sheet feeder. The delivery table drive roller pulley is preferably somewhat smaller than the drive roller of the feeder, so that the delivery table belts travel faster than the feeder belts, thereby separating the sheets on the delivery table from each other. Delivery table feed belts are trained around the delivery table drive roller and around an exit shaft at the downstream, exit, end of the delivery table. These delivery table feed belts are used to advance the sheets away from the feeder's hopper area and toward the printer's manual feed tray feed roller. The exit shaft has a one-way bearing of sufficient diameter to urge the sheet into the digital printer top-feed pulling roller; the one-way bearing spinning freely when the top-feed roller accelerates the sheet into the printer. A sensor, illustratively a photo-eye, at the exit end of the delivery table detects the leading edge of the foremost advancing sheet and signals the feeder to stop advancing the sheet once it has reached the proper position under the printer's feed roller. When the printer's feed roller advances the foremost sheet into the printer, the sensor detects the absence of a sheet and calls for the feeder assembly to deliver another sheet to the exit end of the delivery table.

With the freely pivoting delivery table of the present invention, the user of the digital printer can slide the feeder into position next to the digital printer without removing any components of the digital printer or circumventing any of the electronic sensors or switches on the printer. An additional advantage is that the operator can also easily move the feeder away from the printer and use the manual feed tray normally, since it does not need to be re-attached.

Although the pivoting delivery table is described herein as a feeder for a digital printer, it will be appreciated that its usefulness is not limited thereto. It may also be used for feeding other types of machines having their own friction feeds, including, for example, copying machines, offset printers, thermal printers, and material handling machines such as envelope stuffers or paper folders.

BEST MODE FOR CARRYING OUT THE INVENTION

Figure 1:
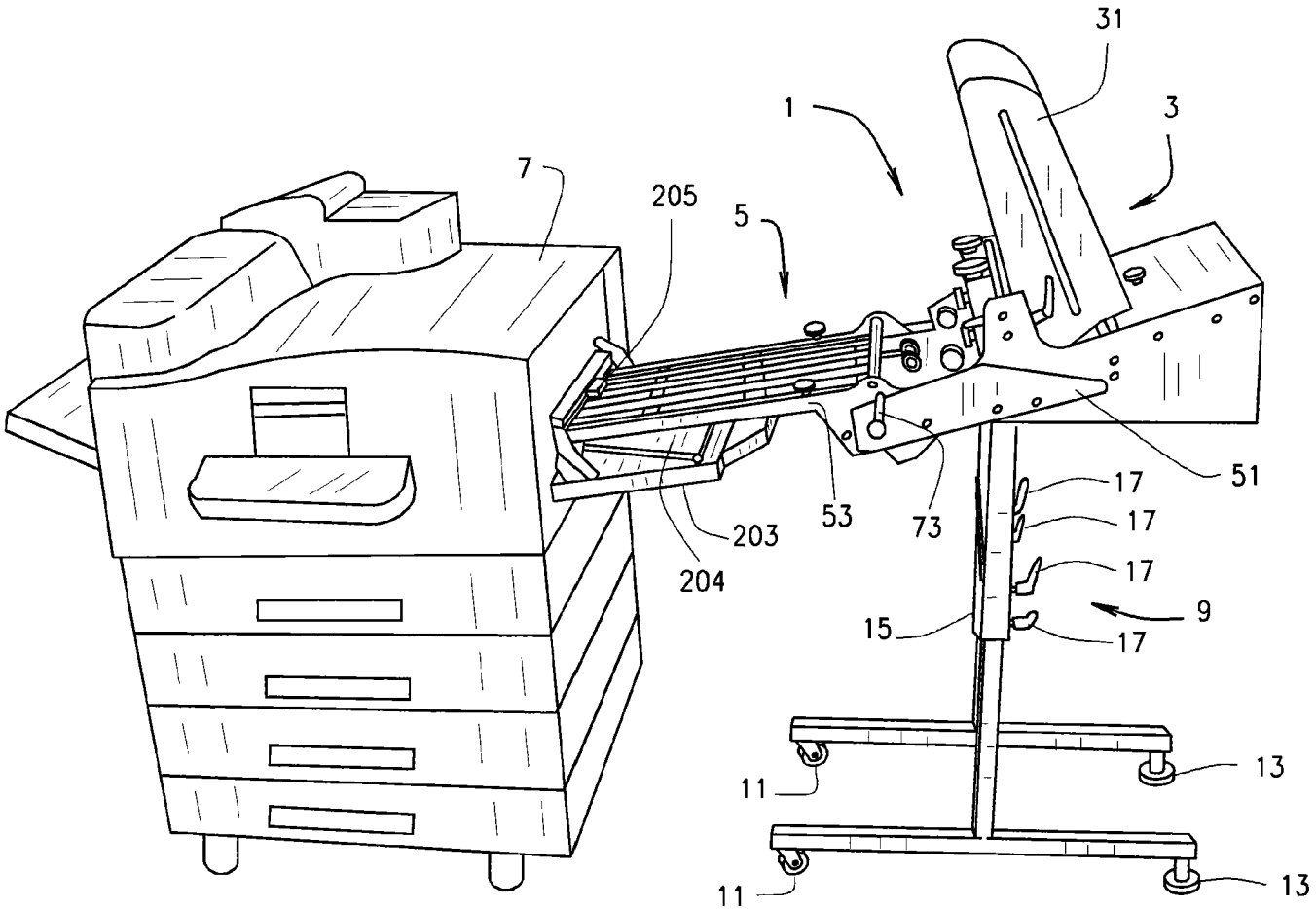
FIG. 1 is a view in left side projection perspective of a standard digital printer with a side mounted manual feed tray that has been opened to access the manual feed tray feeder area and a feeder assembly of the present invention installed on the manual feed tray to feed envelopes into the digital printer.

Referring to the drawings, reference numeral 1 indicates a sheet feeder assembly including a sheet feeder 3 having pivotably attached thereto a delivery table 5. The sheet feeder assembly 1, in this mode of carrying out the invention, interacts with a digital copying machine/printer 7 as described below.

The sheet feeder assembly 1 is mounted on a stand 9 having wheels 11 and adjustable feet 13. The stand 9 has telescoping legs 15 with locks 17 for setting the height of the sheet feeder assembly 1. If the floor on which the stand 9 rests is always expected to be level with the section of floor on which the digital printer 7 rests, the locks 17 may be pins which lock into holes in the legs 15. Otherwise, the locks 17 may be frictional locks of well-known design, to allow slight variance in the heights of the legs 15.

Figure 6:
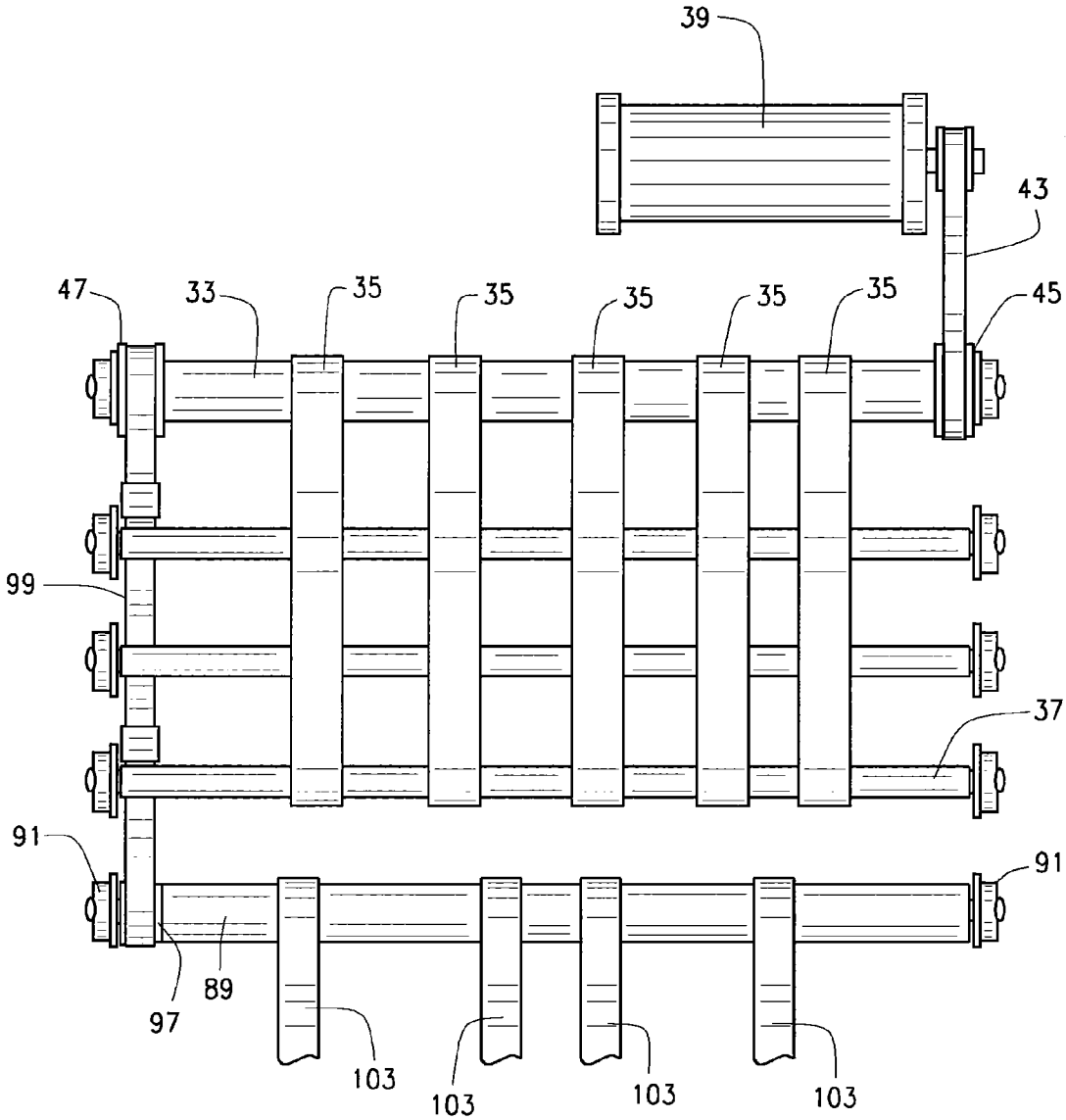
FIG. 6 is a diagrammatic top plan view showing the interrelationship of the drives for a sheet feeder portion and the delivery table portion of the feeder assembly of FIGS. 1-5.

Sheet feeders 3 useable with the present invention are well known in the art. Although the structure of the sheet feeder 3 is not critical to the invention, it is preferably of top-load, bottom-feed design, allowing several hundred sheets to be loaded, and allowing more sheets to be loaded while the feeder is running. The sheet feeder 3 is preferably made in accordance with Kaiping, U.S. Pat. No. 7,624,978, hereby incorporated by reference. In brief, the sheet feeder 3 includes a hopper 31 designed to hold up to five hundred sheets 32 in the form of envelopes or cards, a drive shaft 33, and feed belts 35 trained on the drive shaft 33 and on an idler shaft 37 at the downstream end of the feeder 3. As shown in FIG. 6, the drive shaft 33 is driven at one end by an adjustable speed electric motor 39 through a belt 43 trained over a drive gear 45 on the shaft 33. A second toothed pulley 47 is secured to the other end of drive shaft 33 for purposes described hereinafter. The positions of at least the outer feed belts 35 on the shafts 33 and 37 are adjustable while the feeder 3 is running. Separators 41 extend below the upper faces of the feed belts 35 to buckle the lowermost sheet 32 and separate it from the stack. The feeder 3 is capable of delivering up to two hundred fifty #10 envelopes, having a height of about 4.125" (10.5 cm), per minute.

Figure 3:
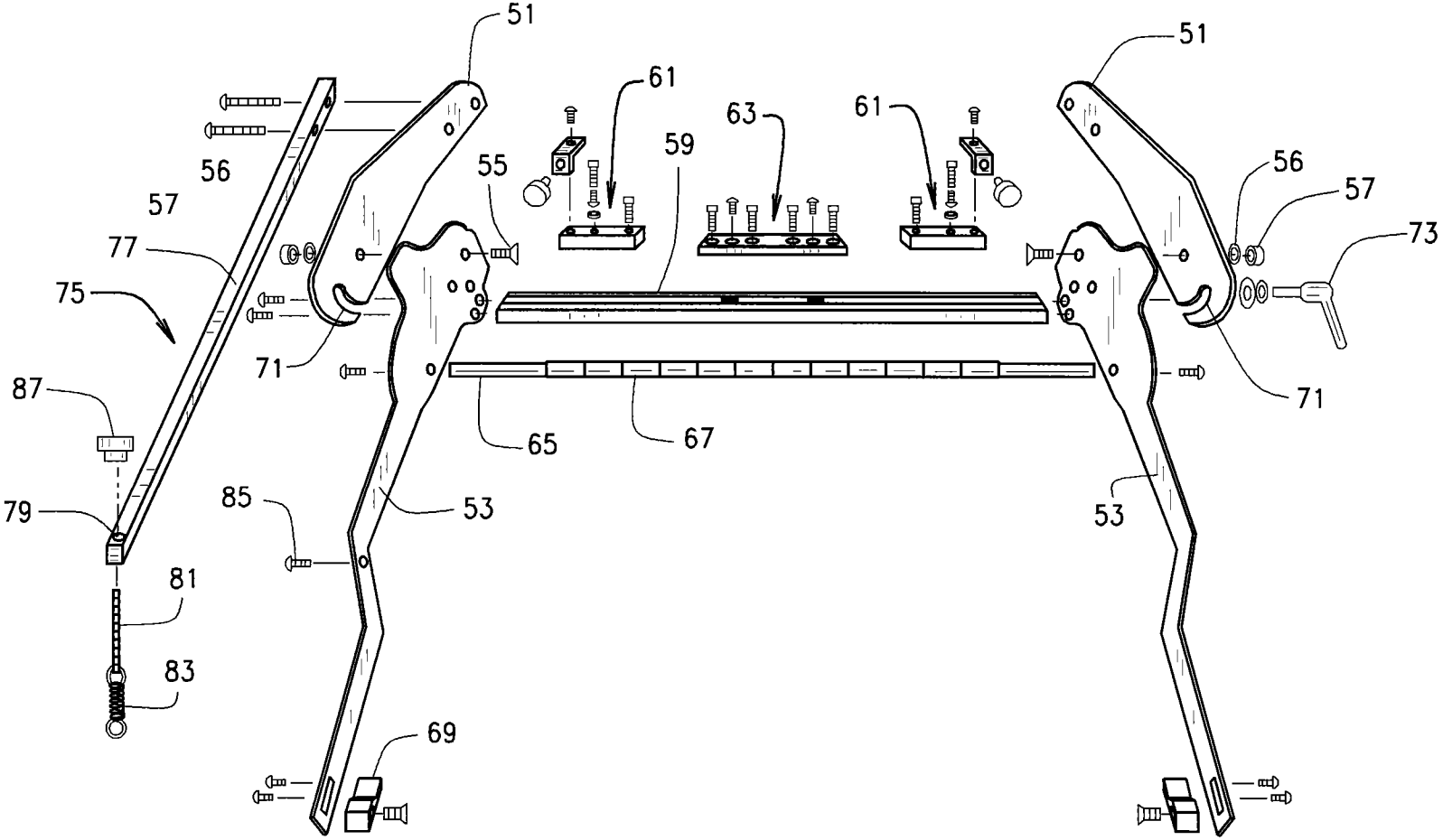
FIG. 3 is an exploded view in exit end projection perspective of frame components and belt guide components of a delivery tray portion of the feeder assembly of FIGS. 1 and 2.
Figure 4:
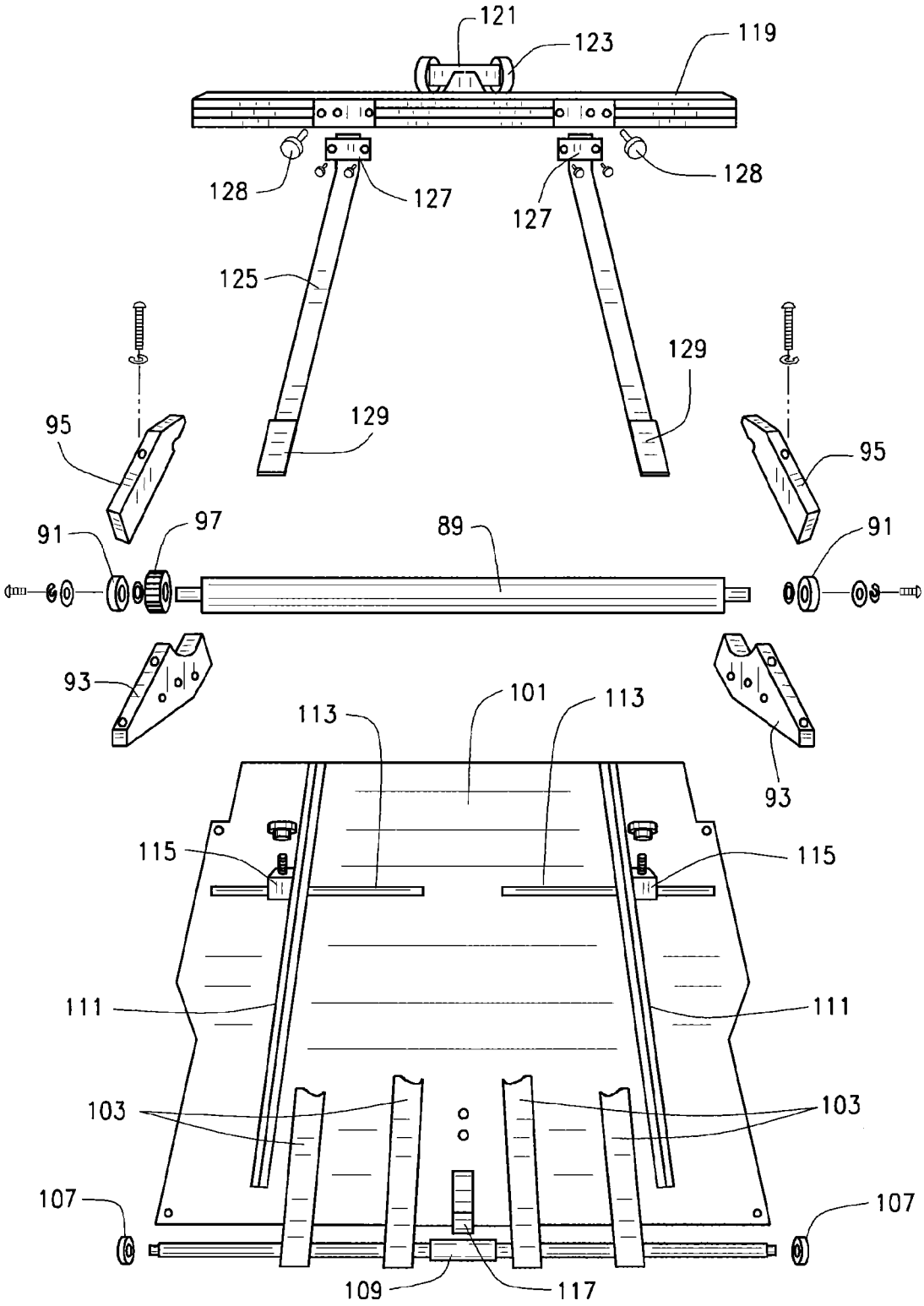
FIG. 4 is an exploded view in exit end projection perspective of drive, bridge, and guide components of the delivery tray portion of the feeder assembly of FIGS. 1 and 2.

The delivery table 5 portion of the feeder assembly 1, as best seen in FIGS. 3 and 4, includes two mounting plates 51 bolted to the sides of the feeder 1. Side plates 53 are freely pivotably mounted to the mounting plates 51 by flat head screws 55, washers 56, and nylon insert lock nuts 57. A belt guide bar 59, mounted between side plates 53, carries manually moveable belt guides 61 and fixed belt guides 63, which straddle lower reaches of delivery belts, as discussed below.

Tensioner shaft 65 is mounted between side plates 53 forward (downstream) of the belt guide bar 59 and carries twelve one-inch (2.54 cm) long ½" (1.23 cm) outer diameter bushings 67. Exit shaft bearing blocks 69 are mounted between the side plates 53 at the forward (exit) end of the delivery table 5. An arcuate slot 71 in one of the mounting plates 51 accepts a locking lever 73 threaded into one of the side plates 53. The locking lever 73 allows the rotational position of the side plates 53 to be fixed during transport and positioning of the feeder assembly, but is loosened thereafter, to allow free pivoting of the delivery table 5 during alignment and use of the feeder assembly 1.

A table lift mechanism 75 is provided as a balance mechanism to reduce the effective weight of the delivery table. The lift mechanism 75 includes an arm 77 bolted to one of the mounting plates 51. The free end of the arm 77 includes a bore 79 sized to allow free passage of a threaded spring rod 81. A coil spring 83 is held at its upper end by the spring rod 81 and at its lower end by a bolt 85 threaded into a side plate 53. An adjustment knob 87, threaded on the spring rod, permits adjustment of the spring tension, hence of the effective weight of the delivery table. If desired, the table can be adjusted to be effectively weightless, although it is preferred that the table exert some downward pressure, simulating a stack of sheets, as discussed hereinafter.

The delivery table 5 further includes a drive shaft 89, best shown in FIGS. 4 and 6, rotatably mounted by flanged roller bearings 91 in bearing blocks 93 and held by bearing caps 95. The bearing caps 95 are easily removed for servicing the drive roller or replacing drive belts. A geared drive pulley 97 is mounted to one end of the drive shaft 89 inside the bearing block 93. A toothed timing belt 99 runs between the drive pulley 97 and the second geared pulley 47 mounted on the end of the feeder drive shaft 33 opposite the end driven by electric motor 39.

A top plate 101 is mounted between the side plates 53 and secured by flat-head bolts to drive shaft bearing blocks 93 and exit shaft bearing blocks 69. The top plate 101 supports the upper run of delivery belts 103 and sheets 32 as they are advanced from the feeder section to the printer by the delivery table feed belts 103.

The delivery table 5 also includes an exit shaft 105 around which delivery table belts 103 are trained. The exit shaft 105 is rotationally driven by the delivery table belts 103. The exit shaft 105 is held in position by the two exit shaft bearing blocks 69 equipped with bearings 107 which allow free rotational movement of the exit shaft 105.

The exit shaft 105 is sized to permit the exit end of the delivery table, including the belts 103, to be less than 1.5" (5.1 cm) high, preferably one-half inch to one inch (1.2-2.5 cm) high, to permit the delivery table to fit into the printer's roller area without disturbing its manual feed tray. In the illustrative embodiment, the shaft 105 is 0.375" (0.95 cm) in diameter, turned down to 0.25" (0.635 cm) at its ends to fit bearings 107, and the height of the side plates 53 and bearing blocks 69 is 0.5625" (1.43 cm) at the exit end of the delivery table. The height of the exit shaft 105 plus the belts 103 is about 0.5" (1.27 cm).

The width of the delivery table 5 is selected to fit a range of digital printers and to allow use with a range of sheet sizes. It will be understood that this requires a compromise. A general-purpose feeder assembly should have a width of at least 8.5" (21.5 cm) to handle U.S. letter-sized paper and should not be wider than about 14" (35.6 cm) to fit most digital printer manual feed trays. The illustrative embodiment has a width of 12.5" (31.8 cm) and can handle sheets 3" (7.6 cm) wide minimum up to 12" (30.5 cm) wide, and from 4" (10 cm) long minimum to 18" (46 cm) long. The envelopes or sheets can be run in portrait or landscape orientation.

A one-way bearing 109 is mounted in the center of the exit shaft 105 and is driven by the exit shaft 105 in the proper direction so as to advance sheets 32 into the printer's feed roller area. The one-way bearing 109 is positioned in use directly below the manual feed tray's feed roller. The one-way bearing 109 rotates freely in the direction of the printer when the printer's feed roller is activated to advance a sheet 32 into the printer; it therefore does not impede advancement of the sheet 32 into the printer.

Figure 5:
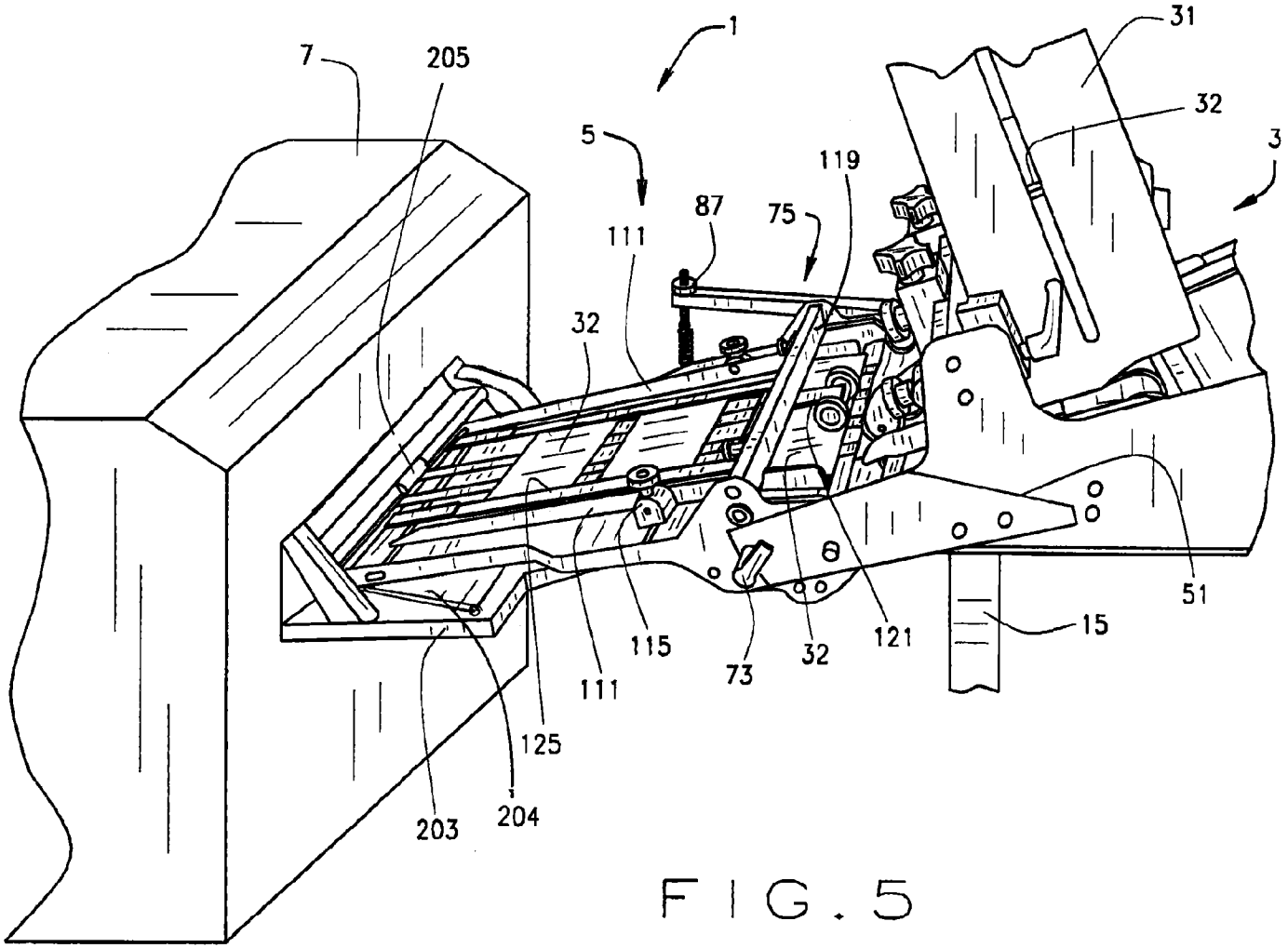
FIG. 5 is a view in left side perspective of the delivery table portion of the feeder assembly of FIGS. 1-4, installed on a bypass tray of a digital printer.

The delivery table drive shaft pulley 97 is preferably of smaller diameter than the pulley 47 on the feeder section drive shaft 33, thereby causing the delivery table drive shaft to rotate at a higher rate than the feeder section drive shaft 33. This results in the delivery table belts 103 having a higher advancing rate than that of the feeder section feed belts 35 and results in a gap between sheets as they advance toward the printer on the delivery table 5, as shown in FIG. 5.

The delivery table top plate 101 includes paper guides 111 which are movable laterally toward and away from each other to accommodate sheets 32 of varying widths. These paper guides 111 serve to align the sheets 32 as they are advanced toward the printer 7 so that each sheet 32 is presented to the printer straight and in uniform position allowing for accurate print registration. Transverse slots 113 in the plate 101 carry adjustment blocks 115 attached to the paper guides, for fixing their position.

The outermost delivery table belts 103 are movable laterally toward and away from the center of the delivery table top plate 101 so as to accommodate sheets of varying widths. This is accomplished by means of the two manually movable belt guides 61 shown in FIG. 3, and located below the top plate 101.

The delivery table top plate 101 includes a photo sensor 117 secured to the bottom of the delivery table top plate 101 near the exit end of the delivery table 5 in a position between two adjacent delivery table belts 103 and directly underneath an opening cut into the delivery table top plate 101. The upward facing photo sensor 117 detects the presence or absence of sheets 32 at the exit end of the delivery table. The photo sensor 117 is electronically attached to the motor control mechanism to signal the motor to start running, advancing the sheets 32 toward the printer when the photo sensor 117 detects the absence of a sheet 32 at the exit end of the delivery table 5. When a sheet 32 has advanced sufficiently to cover the photo sensor 117, the photo sensor 117 signals the motor controller to stop the motor. The sheet 32 therefore stops in the proper position for the printer's feed roller to advance it into the printer.

Figure 2:
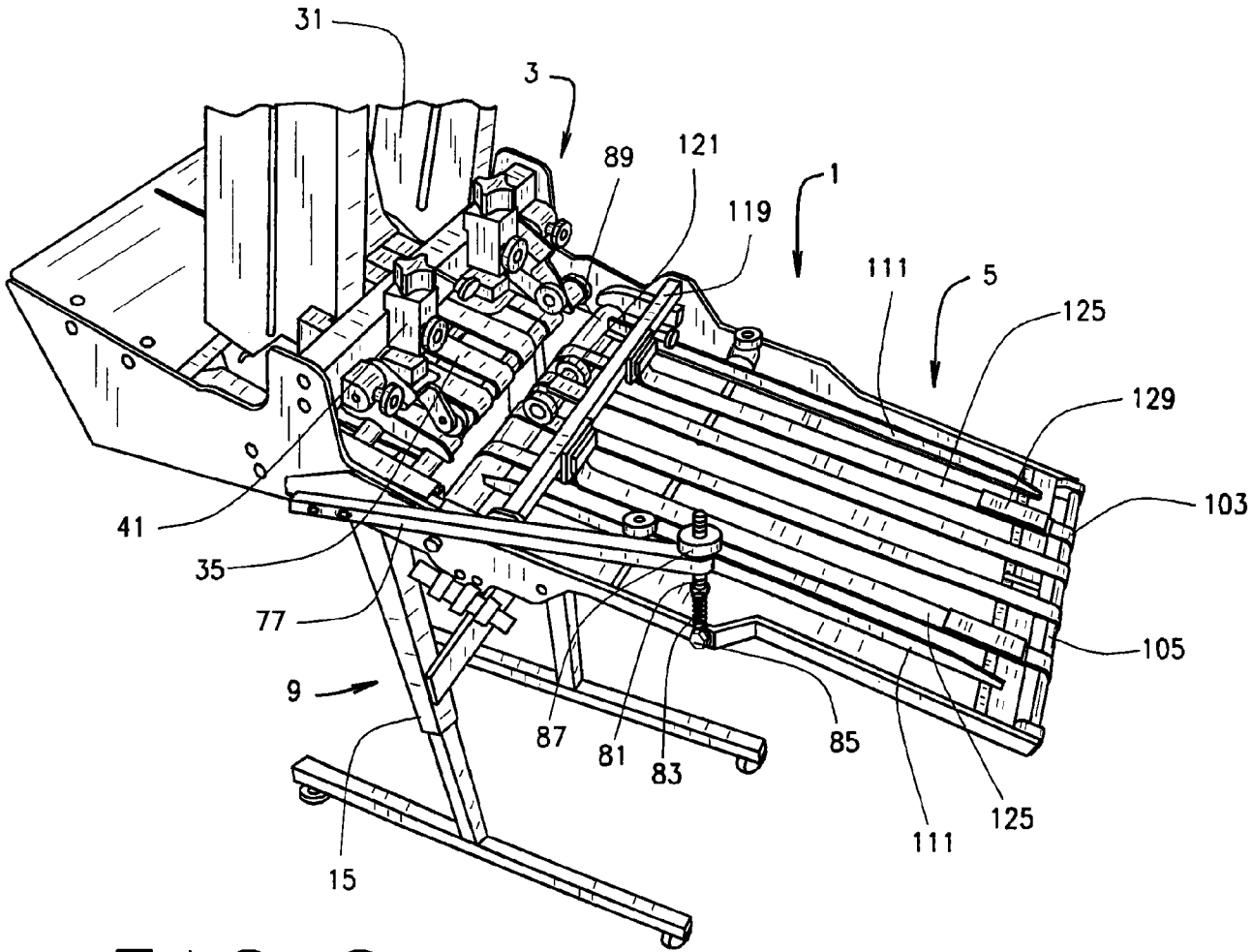
FIG. 2 is a view in right side perspective of the feeder assembly of FIG. 1.

The delivery table 5 includes a bridge 119, best shown in FIGS. 2, 4 and 5, which is attached to the side plates 53 on the ends of the bridge, and positioned above the top plate 101, the delivery belts 103, and the paper guides 111. An input roller assembly 121 is attached to the bridge 119 and includes rollers 123 that are positioned above and resting upon two adjacent central delivery belts 103. The input roller assembly 121 pushes the lead edge of the sheets 32 down onto the delivery belts 103 as the sheets 32 exit the feeder section and enter the delivery table 5. This ensures consistent advancement of the sheets 32 during operation. Also attached to the bridge 119 are two laterally movable sheet hold down straps 125 which rest on top of the sheets 32 as they are advanced toward the printer on the delivery table 5. The hold down straps 125 serve to add sufficient downward force on the sheets 32 to insure adequate friction between the sheets 32 and the delivery belts 103 so as to result in consistent advancement toward the printer of each subsequent sheet 32. The hold down straps 125 are attached to the bridge 119 by two movable slides 127. The movable slides 127, and the attached hold down straps 125, can be repositioned laterally to the most desirable location for varying sheets 32. The movable slides 127 include a locking knob 128 that can be tightened to lock the slides 127 into position. In this embodiment, weights 129 are provided at the free, exit, ends of the hold down straps 125.

Figure 7:
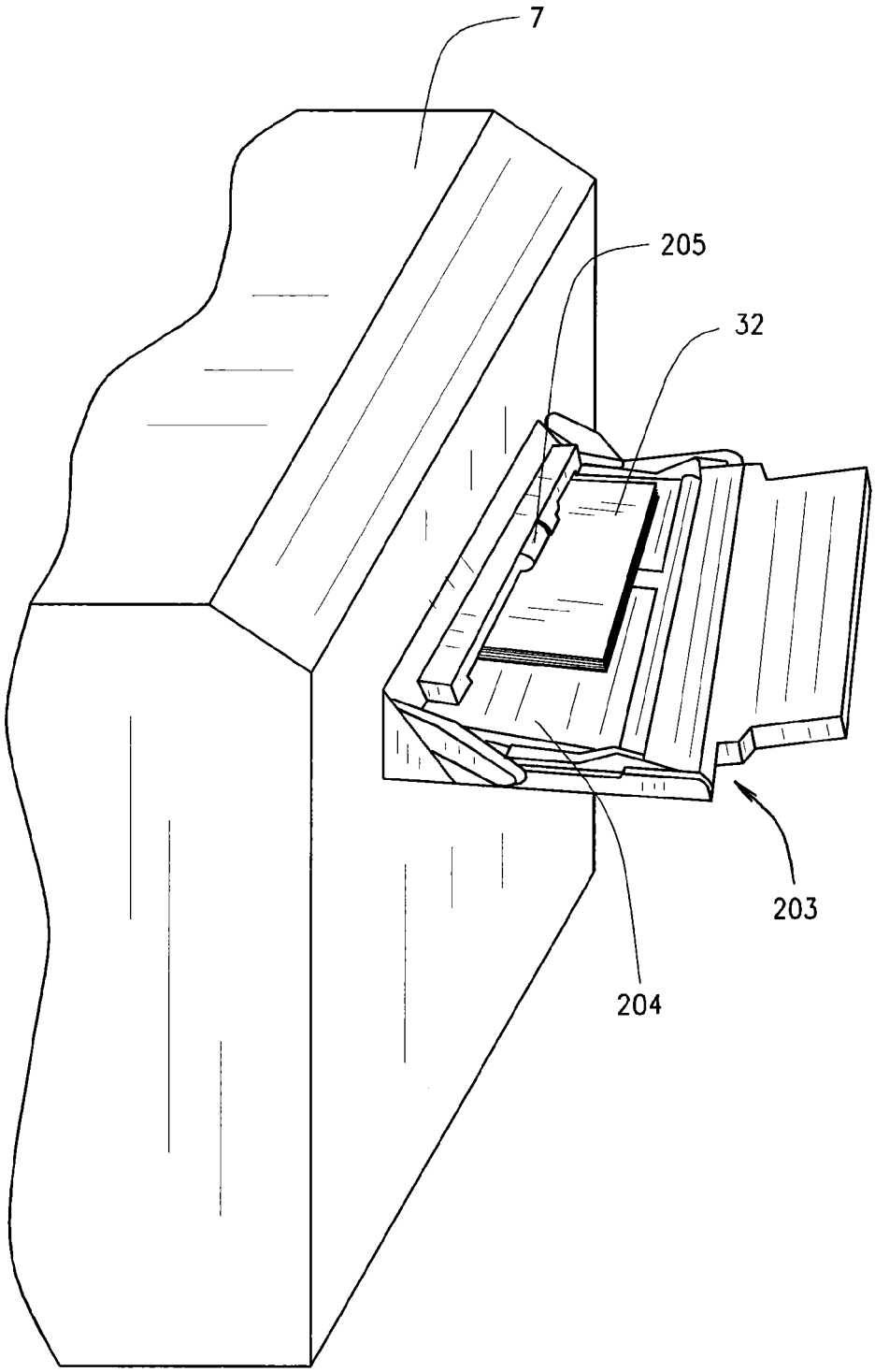
FIG. 7 PRIOR ART
FIG. 7 is a view in left side perspective of a manual feed tray of a digital printer with a small stack of envelopes placed on the manual feed tray and the tray's stack support in a raised position, in accordance with the prior art.

Referring now to FIG. 7, the sheet feeder assembly 1 of the illustrative embodiment is designed for use with high speed digital printer models with a flat paper path giving them the capability to handle envelopes and other thick or difficult sheets. These printers, such as the printer 7 of FIGS. 1 and 7, feature a manual feed tray 203 on the side of the printer. The manual feed tray 203 is used for sheets that do not feed well in the standard internal paper trays. Envelopes are the most common such sheets. FIG. 7 shows the normal orientation of the manual feed tray 203. Under normal usage, a pivoted feed table 204 portion of the manual feed tray 203 drops away a bit from a feed roller 205, allowing the operator to place a small stack of envelopes 32 onto the feed table part of the tray 203. When the printer 7 is activated, the feed table 204 is mechanically raised, bringing the envelopes up until they contact the feed roller 205 or a sensor adjacent the feed roller 205. The feed roller 205 pulls the top envelope 32 off the stack and pushes it into the printer 7. This is repeated until the envelope stack is exhausted, when the feed table 204 will drop, allowing the operator to place another small stack of envelopes into the tray 203. This process is tedious, and the manual feed tray 203 typically only holds twenty to thirty envelopes, therefore requiring constant reloading.

When using the sheet feeder assembly 1 of the present invention, the manual feed tray 203 is first emptied of any envelopes, causing the feed table 204 to drop to its lowest position. Paper guides on the tray are moved laterally outward to make maximum room for the delivery table 5 of the sheet feeder assembly 1. The exit end of the sheet feeder assembly's delivery table is then positioned into the manual feed tray 203, with the exit shaft just under the manual feed roller. Height adjustments may be made by loosening the locks 17 on the legs 15 of the stand 9 and then tightening the leg locks 17 when the proper height is reached. The locking lever on the left (operator) side of the delivery table is loosened so the delivery table can pivot freely. The delivery table 5 is lifted over the opened manual feed tray 203 and slid into position so the delivery table goes in above the manual feed tray 203 and between the manual feed tray 203 paper guides. The end of the delivery table 5 is allowed to drop gently onto the feed table 204 of the manual feed tray 203, and the feeder assembly 1 is pushed forward until the exit end of the delivery table 5 bumps into the front wall of the manual feed tray 203 and the one-way bearing 109 on the delivery table exit shaft is positioned just below, but not contacting, the manual feed tray 203 feed roller 205.

In normal operation, the feed table 204 will push the delivery table 5 up until the one-way bearing contacts the manual feed tray 203 feed roller 205. The one-way bearing will press the first envelope 32 against the manual feed tray 203 feed roller 205, but will spin freely as the feed roller pulls the envelope away.

Because the feed table 204 will be required to lift the sheet feeder assembly delivery table up to the feed roller, it is desirable to minimize the force it is required to exert, using the balance mechanism 75. Once the feeder assembly 1 is in position with the printer 7, and the printer has not been started, the adjustment knob 87 is turned clockwise until the delivery table just starts to lift toward the feed roller. The one-way bearing 109 should not be lifted up to the feed roller; this is to be done by the feed table 204. The lift assist should only be strong enough to aid the feed table 204.

When the printer is activated, the feed table 204 lifts normally, which simply lifts the sheet feeder assembly's floating delivery table 5 up to the feed roller 205, simulating a stack of envelopes. When the delivery table is pushed up it raises the feed roller 205 or its sensor to the proper height, and the feed table 204 stops rising. The sheet feeder assembly then feeds a single envelope 32 to the feed roller 205, and on an internal signal from the printer 7 the feed roller 205 pulls the envelope into the printer. The photo sensor 117 mounted at the end of the delivery table detects when the first envelope 32 has left the delivery table 5, and signals the feeder assembly 1 to advance another envelope 32 to the manual feed roller 205. This process is repeated for each envelope required, with the feeder assembly being activated only when the photo sensor 117 detects the absence of a sheet at the forward (exit) end of the delivery table 5.

Numerous variations in the construction of the feeder assembly of this invention, within the scope of the appended claims, will occur to those skilled in the art in light of the foregoing disclosure. Merely by way of example, other feeders may be used with the pivoting table. Although not preferred, the entire feeder assembly, including the table, could be pivotably mounted on a vertically adjustable stand. The balance mechanism which reduces the effective weight of the delivery table may include other types of springs, counterweights, or other known mechanisms. The top-feeding device into which the feeder assembly feeds may include different feed mechanisms. For example, the entire manual feed tray may lift when the printer calls for a sheet from the manual feed tray. The top-feeding device may be a simple vertically floating top-feed roller with a sheet sensor, adapted to handle a small stack of only a few sheets on a fixed sheet support. Rather than utilizing two different size pulleys to create different belt speeds between the feeder section and the delivery table section, the speed difference can be created by utilizing two different size shafts as well as utilization of a separate, independently controlled motor for the delivery table. Other devices, such as offset printing presses, utilize vacuum pickups, rather than feed rollers, as feeds, to move the top sheet of a stack into the device; the feeder assembly of the invention may be used with such devices, although the one-way roller is less important.

These variations are merely illustrative.

The invention claimed is:

1. In combination,
- a printer having
- a top-feed roller accessible from outside the printer and
- a feed table positioned to hold a stack of sheets to be fed into the top-feed roller, and
- a feeder assembly comprising
  - a bottom-feed sheet feeder physically and electrically separate from the printer, and
  - a delivery table positioned to receive sheets from the sheet feeder and deliver the sheets one at a time to the top-feed roller, the delivery table being pivotably mounted relative to the printer to allow a free end of the delivery table to move vertically freely with respect to the top-feed roller, the delivery table being positioned on the feed table.

2. The combination of claim 1 wherein the delivery table includes feed belts which move the sheets from the feeder to the top-feed roller of the printer.

3. The combination of claim 1 wherein the feed table moves upwardly to feed sheets to the top feed roller, the delivery table being positioned to be moved by the feed table.

4. The combination of claim 1 wherein the delivery table is pivotably mounted to the bottom-feed sheet feeder.

5. The combination of claim 2 wherein feed belts of the delivery table are driven by the sheet feeder.

6. The combination of claim 5 wherein the sheet feeder includes a sheet feeder drive roller driven by an electric motor, and wherein the feed belts of the delivery table are trained on a drive table drive roller driven by the sheet feeder drive roller.

7. The combination of claim 5 wherein the belts of the delivery table are driven at a higher speed than the speed at which sheets are delivered by the sheet feeder.

8. In combination, a device having a top-feed mechanism accessible from outside the device, the top-feed mechanism including a vertically moveable support adapted to hold a stack of sheets and structure that repeatedly delivers the top sheet from the stack into the device, and a feeder assembly comprising a bottom-feed sheet feeder physically and electrically separate from the device, and a delivery table positioned to receive sheets from the sheet feeder and deliver the sheets one at a time to the top-feed mechanism, an exit end of the delivery table being supported by the vertically moveable support and positioned vertically by the vertically moveable support during operation.

9. A sheet feeder assembly adapted to feed sheets to a device having a top-feed mechanism which pulls a top sheet from a stack of sheets, the sheet feeder assembly comprising a sheet feeder having a stack hopper adapted to hold a stack of sheets, and feed belts positioned to advance a bottom-most sheet from said stack, and a delivery table positioned to receive sheets from the feed belts at a rearward end of the table and to deliver the sheets to a forward end of the table, the rearward end of the delivery table being pivotably attached to the sheet feeder and being capable of being pivoted at least ten degrees in a vertical direction while the sheet feeder assembly is in operation.

10. The sheet feeder assembly of claim 9 wherein the delivery table is provided with a balance mechanism which reduces the effective weight of the table.

11. A method of feeding sheets to a device that includes a pulling mechanism which pulls a top sheet from a stack of sheets, a support for the stack of sheets and a sensor which detects the presence of at least one sheet, the method comprising placing a sheet delivery table on the support to simulate a stack of sheets, and thereafter feeding sheets one at a time to the sheet delivery table from a bottom-feeding, top-loading sheet feeder.

12. The method of claim 11 comprising feeding a sheet in response to sensing the absence of a sheet at a position on the sheet delivery table to be pulled by the device.

13. The method of claim 11 wherein the support lifts in response to the presence of a stack of sheets, and wherein the delivery table is provided with a balance mechanism which reduces the effective weight of the table to a weight which can be lifted by the support.

14. The method of claim 13 wherein the balance mechanism comprises a spring.

15. The method of claim 11 wherein placing the delivery table on the support permits feeding of sheets from the delivery table without modifying the support or the sensor.

16. A sheet feeder assembly adapted to feed sheets to a device having a top-feed mechanism which pulls a top sheet from a stack of sheets, the sheet feeder assembly comprising a sheet feeder having a stack hopper adapted to hold a stack of sheets, and feed belts positioned to advance a bottom-most sheet from said stack, and a delivery table positioned to receive sheets from the feed belts at a rearward end of the table and to deliver the sheets to a forward end of the table, a rearward end of the delivery table being freely pivotably attached to the sheet feeder.

17. The sheet feeder assembly of claim 16 further comprising a balance mechanism which reduces the effective weight of a forward end of the delivery table.

* * * * *